US008950441B2

(12) United States Patent
Ding et al.

(10) Patent No.: US 8,950,441 B2
(45) **Date of Patent: *Feb. 10, 2015**

(54) RECIPROCATING COMPRESSOR WITH HIGH PRESSURE STORAGE VESSEL LET DOWN FOR CNG STATION AND REFUELING MOTOR VEHICLES

(75) Inventors: Denis Ding, Riverside, CA (US); Mitchell Pratt, Orange, CA (US)

(73) Assignee: Clean Energy Fuels Corp., Newport Beach, CA (US)

( * ) Notice: Subject to any disclaimer, the term of this patent is extended or adjusted under 35 U.S.C. 154(b) by 785 days.

This patent is subject to a terminal disclaimer.

(21) Appl. No.: 13/151,072

(22) Filed: Jun. 1, 2011

(65) Prior Publication Data

US 2011/0303323 A1 Dec. 15, 2011

Related U.S. Application Data

(60) Provisional application No. 61/353,625, filed on Jun. 10, 2010.

(51) Int. Cl.

| | |
|---|---|
| ***B67C 3/00*** | (2006.01) |
| ***F17C 5/06*** | (2006.01) |
| ***B65B 1/20*** | (2006.01) |

(52) U.S. Cl.

CPC .... *F17C 5/06* (2013.01); *B65B 1/20* (2013.01)
USPC ..... 141/4; 141/82; 141/94; 141/197

(58) Field of Classification Search

CPC ..... F17C 2223/0123; F17C 2225/0123; F17C 2227/043; F17C 2270/0139; F17C 2265/065; F17C 5/06
USPC ..... 141/1, 4, 11, 82, 94–95, 197
See application file for complete search history.

(56) References Cited

U.S. PATENT DOCUMENTS

| | | | | |
|---|---|---|---|---|
| 4,805,674 | A | 2/1989 | Knowlton | |
| 7,624,770 | B2 * | 12/2009 | Boyd et al. | 141/11 |
| 7,721,682 | B2 | 5/2010 | Fulton | |
| 7,967,036 | B2 | 6/2011 | Ding | |
| 7,987,877 | B2 * | 8/2011 | Bavarian et al. | 141/5 |
| 2007/0042241 | A1 | 2/2007 | Matsuo | |
| 2008/0196384 | A1 | 8/2008 | Ding | |
| 2009/0071565 | A1 | 3/2009 | Ding | |
| 2011/0101024 | A1 | 5/2011 | Ding | |
| 2011/0155278 | A1 | 6/2011 | Ding | |

* cited by examiner

*Primary Examiner* — Timothy L Maust
*Assistant Examiner* — Timothy P Kelly
(74) *Attorney, Agent, or Firm* — Sheppard Mullin Richter & Hampton LLP

(57) ABSTRACT

Embodiments of the present invention are directed toward a reciprocating compressor having a high pressure storage vessel let down for a CNG station for refueling motor vehicles, wherein the CNG station design utilizes inlet gas from a local gas utility. By supplementing the inlet gas with a pressure let down in order to de-pressurize the gas from a high-pressure storage vessel, the CNG station has the ability to increase and adjust its flow capacity.

21 Claims, 2 Drawing Sheets

RECIPROCATING COMPRESSOR WITH HIGH PRESSURE STORAGE VESSEL LET DOWN FOR CNG STATION AND REFUELING MOTOR VEHICLES

REFERENCES TO RELATED APPLICATIONS

This application claims the benefit of U.S. Provisional Patent Application No. 61/353,625, filed Jun. 10, 2010, the content of which is incorporated herein by reference in its entirety.

FIELD OF THE INVENTION

The present invention relates generally to compressors for compressed natural gas (CNG) stations for refueling motor vehicles, and more particularly to a reciprocating compressor having a high pressure storage vessel let down for a CNG station for refueling motor vehicles.

BACKGROUND OF THE INVENTION

Most conventional CNG stations are custom designed for specific site conditions, and must operate within predetermined inlet gas pressure and flow ranges. These stations usually take a long time to build, and since they are designed to meet specific site conditions, the flow capacity is limited by the inlet gas pressure available by the local gas utility. According to other known CNG designs, the site conditions are modified to meet the equipment design specifications by utilizing an inlet gas regulator. Due to compressor design limitations, these stations often have to sacrifice gas pressure by going through the inlet regulator. After the gas is de-pressurized by the inlet regulator, it is then re-pressurized in the compressor. This design is very energy inefficient since the gas pressure is lowered before recompression in the compressor. Both custom-designed and site-modified systems are generally fixed speed and do not permit flow capacity control.

SUMMARY OF THE INVENTION

The present invention provides a reciprocating compressor having a high pressure storage vessel let down for a CNG station for refueling motor vehicles, wherein the CNG station design utilizes inlet gas from a local gas utility. By supplementing the inlet gas with a pressure let down (de-pressurizing) gas from a high-pressure storage vessel, the CNG station has the ability to increase and adjust its flow capacity. Various embodiments of the invention involve a system and method for accepting pressure let down (de-pressurizing) gas from the high-pressure storage vessels, thereby increasing the inlet gas pressure to the reciprocating compressor and providing higher and adjustable flow capacity for the CNG refueling station.

Some embodiments of the invention are directed to a natural gas compression system that has the ability to take the inlet gas pressure from a local gas utility feed gas to a higher gas pressure by way of pressure let down (depressurized) gas from a high pressure storage vessels, thus providing an increased and adjustable gas flow capacity to meet different load requirement and optimize energy utilization. In other words, the pressure let down from the high pressure storage vessels provides a higher inlet gas pressure to the compressor and the ability to control and increase the gas flow capacity. In various embodiments, the pressure let down section may include, but is not limited to: shutoff valves (automatic and/or manual), multi-stage depressurization regulators, pressure transducers, and gauges to monitor its operation.

By way of example, the high pressure compressor may comprise a rotary, single-screw, positive-displacement compressor including a drive shaft, a main screw having six helical grooves, and two planar gaterotors. For some CNG applications, the compressor may comprise a positive-displacement compressor that may or may not include a single-screw booster in front of the compressor. In such compressors, the drive shaft imparts rotary motion to the main screw, which drives the intermeshed gaterotors, whereby compression of the gas is achieved by engaging the two gaterotors with helical grooves in the main screw. Gas compression occurs when the individual fingers of each gaterotor sweep through the grooves of the main screw as the screw rotates. Other types of high pressure compressors may be employed without departing from the scope of the invention.

One embodiment of the invention features a reciprocating compressor having a high pressure storage vessel let down for a CNG station for refueling motor vehicles, the reciprocating compressor comprising: (i) a gas inlet section including an inlet gas meter for metering inlet gas from a high pressure storage vessel; (ii) a compressor section; (iii) a valve control panel and storage section; (iv) a pressure let down section that depressurizes the high pressure gas from the high pressure storage vessel to the inlet of the compressor section; and (v) a dispensing section, wherein the CNG station design utilizes inlet gas from a local gas utility, and wherein the gas inlet section is provided and delivered to the site location by a local gas utility.

By supplementing the inlet gas with a pressure let down in order to de-pressurize the gas from the high-pressure storage vessel, the CNG station has the ability to increase and adjust its flow capacity. The compressor section may comprise a single high pressure reciprocating compressor such as a rotary, single-screw, positive-displacement compressor including a drive shaft, a main screw having six helical grooves, and two planar gaterotors. In some embodiments, the compressor section may comprise a combination of multiple reciprocating compressors configured in parallel. The valve control panel and storage section may comprise a series of control valves that direct the flow of gas from the compressor to either local storage vessels or to the dispensing section. Valve panel design may vary based on the station application. In some implementations, the valve control panel and storage section comprises automatic and manual valves, pressure transducers and gauges to direct the gas from the compressors to either storage vessels or dispensers/vehicles. The dispensing section may comprise one or more dispensers such as fast fill dispensers or time fill dispensers.

In some embodiments of the invention, the pressure let down section of the reciprocating compressor is capable of drawing the gas from the high pressure vessel at a pressure from 3600 psig to 4500 psig down to a pressure of 20 psig to 200 psig before it enters the compressor section. As such, the pressure let down section allows the reciprocating compressor to operate at a high flow capacity during peak hours. Additionally, the pressure let down section allows the reciprocating compressor to draw in gas from the local gas utility and refill the high pressure storage vessels at a slower flow capacity and at a lower power level during non-peak hours. The ability to provide higher flow during peak hours and slower flow during non-peak hours provides the CNG station with the ability to actively manage the gas supply and demand levels and control the power draw requirement of the CNG station.

Another embodiment of the invention is directed toward method for refueling motor vehicles using a reciprocating compressor having a high pressure storage vessel let down for a CNG station, comprising: metering inlet gas from a high pressure storage vessel, depressurizing high pressure gas from the high pressure storage vessel to an inlet of a compressor section, and dispensing the gas. In some cases the CNG station design utilizes inlet gas from a local gas utility, and a gas inlet section for metering inlet gas from the high pressure storage vessel is provided and delivered to the site location by a local gas utility.

In the above method, depressurizing high pressure gas may comprise supplementing the inlet gas with a pressure let down in order to depressurize the gas from the high-pressure storage vessel, whereby the CNG station has the ability to increase and adjust its flow capacity. This step may be performed by a pressure let down section that draws the gas from the high pressure vessel at a pressure from 3600 psig to 4500 psig down to a pressure of 20 psig to 200 psig before it enters the compressor section. In some embodiments, the pressure let down section allows the reciprocating compressor to operate at a high flow capacity during peak hours, wherein the pressure let down section allows the reciprocating compressor to draw in gas from the local gas utility and refill the high pressure storage vessels at a slower flow capacity and at a lower power level during non-peak hours. The ability to provide higher flow during peak hours and slower flow during non-peak hours provides the CNG station with the ability to actively manage the gas supply and demand levels and control the power draw requirement of the CNG station.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein may illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
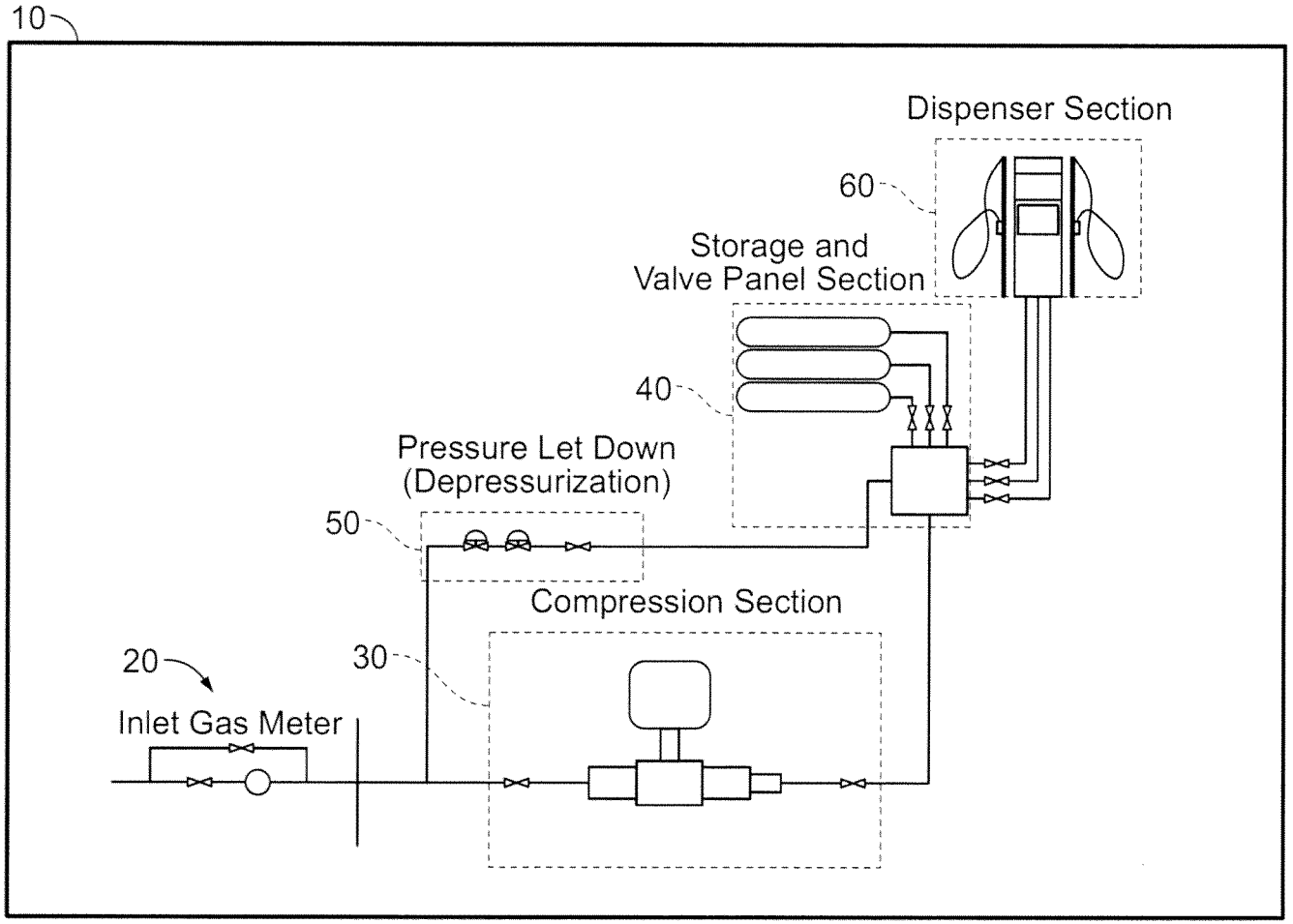

Embodiments of the present invention will now be described, by way of example only, with reference to the following drawings, in which:

FIG. 1 is a schematic diagram illustrating a reciprocating compressor system having an inlet booster design, in accordance with the principles of the present invention.

Figure 2:
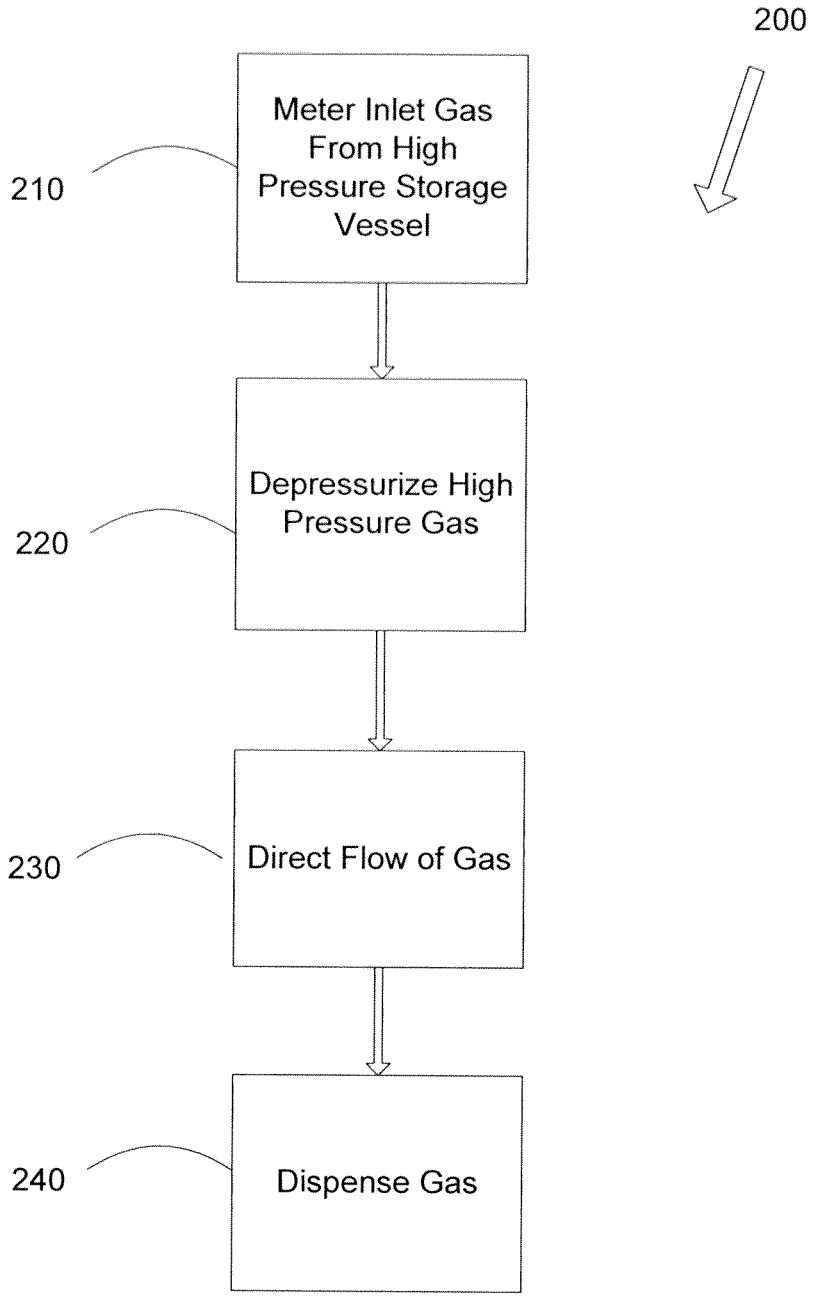

FIG. 2 is a diagram illustrating a method for refueling motor vehicles using a reciprocating compressor having a high pressure storage vessel let down for a CNG station, in accordance with the principles of the present invention.

DETAILED DESCRIPTION OF THE PREFERRED EMBODIMENTS

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Embodiments of the present invention are directed to a reciprocating compressor having a high pressure storage vessel let down for a CNG station for refueling motor vehicles, wherein the CNG station design utilizes inlet gas from the local gas utility. By supplementing the inlet gas with a pressure let down in order to de-pressurize the gas from a high-pressure storage vessel, the CNG station has the ability to increase and adjust its flow capacity.

Referring to FIG. 1, in accordance with an embodiment of the invention, a reciprocating compressor 10 with pressure let down design comprises a gas inlet section 20 including an inlet gas meter for metering inlet gas from a high pressure storage vessel, a compressor section 30, a valve control panel and storage section 40, a pressure let down section 50 that depressurizes the high pressure gas from the high pressure storage vessel to the inlet of the compressor section 30, and a dispensing section 60. In most cases, the gas inlet section 20 is provided and delivered to the site location by a local gas utility. However, the gas inlet section 20 may be provided by other means without departing from the scope of the invention.

In some embodiments, the compressor section 30 comprises a single high pressure reciprocating compressor. By way of example, the high pressure compressor may comprise a rotary, single-screw, positive-displacement compressor including a drive shaft, a main screw having six helical grooves, and two planar gaterotors. For some CNG applications, the compressor may comprise a positive-displacement compressor that may or may not include a single-screw booster in front of the compressor. In such compressors, the drive shaft imparts rotary motion to the main screw, which drives the intermeshed gaterotors, whereby compression of the gas is achieved by engaging the two gaterotors with helical grooves in the main screw. Gas compression occurs when the individual fingers of each gaterotor sweep through the grooves of the main screw as the screw rotates. Other types of high pressure compressors may be employed without departing from the scope of the invention. For example, the compressor section 30 may comprise a combination of multiple reciprocating compressors configured in parallel.

With continued reference to FIG. 1, the valve control panel and storage section 40 may comprise a series of control valves that direct the flow of gas from the compressor to either local storage vessels or to the dispensing component(s) of the dispensing section 60. Valve panel design may vary based on the station application. By way of example, in one embodiment, the valve control panel and storage section 40 comprises automatic and manual valves, pressure transducers and gauges to direct the gas from the compressors to either storage vessels or dispensers/vehicles. The pressure let down section 50 depressurizes the high pressure inlet gas from the high pressure storage vessel to the inlet of the compressor section 30. In various embodiments, the pressure let down section 50 may include, but is not limited to: shutoff valves (automatic and/or manual), multi-stage depressurization regulators, pressure transducers, and gauges to monitor its operation. In some embodiments, the pressure let down section 50 depressurizes high pressure inlet gas from a combination of multiple high pressure storage vessels. The dispensing section 60 may comprise one or more dispensers such as fast till dispensers or time fill dispensers.

Conventional CNG station designs do not feature a pressure let down section. Due to compressor design limitations, such stations typically have to sacrifice gas pressure by going through an inlet regulator. After the gas is de-pressurized by the inlet regulator, it is then re-pressurized in the compressor. Such conventional CNG station designs are very energy inefficient since the gas pressure is lowered before recompression in the compressor. By contrast, the embodiments of the present invention feature a pressure let down section 50 that that depressurizes the high pressure gas from the high pressure storage vessel to the inlet of the reciprocating compressor 10.

As set forth above, the pressure let down section 50 of the reciprocating compressor 10 provides the ability to increase gas flow capacity by allowing higher pressure gas into the inlet of the reciprocating compressor 10 and the ability to control the gas flow of the reciprocating compressor 10. Additionally, the use of the pressure let down section 50 increases utilization of the high pressure storage vessel. In conventional CNG station designs, the high pressure storage vessels are typically filled to a pressure of approximately 3600 psig to 4500 psig, and are then drawn down to fill the vehicles to a pressure of approximately 2000 psig to 3000 psig. By employing the pressure let down section 50, the reciprocating compressor 10 of the invention is capable of drawing the gas from the high pressure vessel (i.e., from approximately 3600 psig to 4500 psig) down to approximately 20 psig to 200 psig before it enters the compressor section 30.

Embodiments of the reciprocating compressor 10 of the invention can provide high flow capacity during the time of the day when there is a high level of filling demands (i.e., during peak hours). In addition, during non-peak hours the reciprocating compressor 10 may be configured to draw in gas from the local gas utility and refill the high pressure storage vessel(s) at a slower flow capacity and at a lower power level. This ability to provide higher flow during peak hours and slower flow during non-peak hours provides the CNG station with the ability to actively manage the gas supply and demand levels and control the power draw requirement of the CNG station. Moreover, the gas supply and demand levels may be balanced against the different demand and energy costs of the local gas utility during different times of day, thereby reducing overall operating costs. Furthermore, the reciprocating compressor 10 also provides flexibility in CNG station operation, for example when the local gas utility changes the inlet gas pressure due to maintenance or other reasons.

Referring to FIG. 2, a method 200 for refueling motor vehicles using a reciprocating compressor having a high pressure storage vessel let down for a CNG station will now be described. Specifically, the method 200 comprises metering inlet gas from a high pressure storage vessel (step 210), depressurizing high pressure gas from the high pressure storage vessel to an inlet of a compressor (step 220), directing the flow of gas from the compressor to either local storage vessels or to a dispensing section for dispensing the gas (step 230) and dispensing the gas (step 240). In some cases, the CNG station design utilizes inlet gas from a local gas utility, and a gas inlet section for metering inlet gas from the high pressure storage vessel is provided and delivered to the site location by a local gas utility.

In the above method, depressurizing high pressure gas (step 220) may comprise supplementing the inlet gas with a pressure let down in order to depressurize the gas from the high-pressure storage vessel, whereby the CNG station has the ability to increase and adjust its flow capacity. This step may be performed by a pressure let down section that draws the gas from the high pressure vessel at a pressure from 3600 psig to 4500 psig down to a pressure of 20 psig to 200 psig before it enters the compressor section. In some embodiments, the pressure let down section allows the reciprocating compressor to operate at a high flow capacity during peak hours, wherein the pressure let down section allows the reciprocating compressor to draw in gas from the local gas utility and refill the high pressure storage vessels at a slow flow capacity and at a lower power level during non-peak hours. The ability to provide higher flow during peak hours and slower flow during non-peak hours provides the CNG station with the ability to actively manage the gas supply and demand levels and control the power draw requirement of the CNG station.

Thus, it is seen that a reciprocating compressor having a high pressure storage vessel let down for a CNG station for refueling motor vehicles is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

What is claimed is:

1. A system, comprising:

a gas inlet section including an inlet gas meter for metering inlet gas from a high pressure storage vessel;

a compressor section;

a valve control panel and storage section;

a pressure let down section comprising multi-stage depressurization regulators, pressure transducers, and gauges to monitor its operation, wherein the pressure let down section depressurizes the high pressure gas from the high pressure storage vessel to the inlet of the compressor section, thereby increasing the flow capacity of the system and providing the ability to increase and adjust its flow capacity; and a dispensing section.

2. The system of claim 1, wherein the system utilizes inlet gas from a local gas utility.

3. The system of claim 1, wherein the gas inlet section is provided and delivered to the site location by a local gas utility.

4. The system of claim 1, wherein the compressor section comprises a single high pressure reciprocating compressor.

5. The system of claim 4, wherein the high pressure compressor comprises a rotary, single-screw, positive-displacement compressor including a drive shaft, a main screw having six helical grooves, and two planar gaterotors.

6. The system of claim 1, wherein the compressor section comprises a combination of multiple reciprocating compressors configured in parallel.

7. The system of claim 1, wherein the valve control panel and storage section comprises a series of control valves that direct the flow of gas from the compressor to either local storage vessels or to the dispensing section.

8. The system of claim 1, wherein the dispensing section comprises one or more dispensers selected from the group consisting of fast fill dispensers and time fill dispensers.

9. The system of claim 1, wherein the pressure let down section is capable of drawing the gas from the high pressure vessel at a pressure from 3600 psig to 4500 psig down to a pressure of 20 psig to 200 psig before it enters the compressor section.

10. The system of claim 1, wherein the pressure let down section allows the compressor to operate at a high flow capacity during peak hours, and wherein the pressure let down section allows the reciprocating compressor to draw in gas from the local gas utility and refill the high pressure storage vessels at a slower flow capacity and at a lower power level during non-peak hours.

11. The system of claim 10, wherein the ability to provide higher flow during peak hours and slower flow during non-peak hours provides the system with the ability to actively manage the gas supply and demand levels and control the power draw requirement of the system.

12. A method for refueling motor vehicles using a system having a high pressure storage vessel let down for a CNG station, the method comprising:

metering inlet gas from a high pressure storage vessel;

depressurizing high pressure gas from the high pressure storage vessel to an inlet of a compressor using a pressure let down comprising multi-stage depressurization regulators, pressure transducers, and gauges to monitor its operation, thereby increasing the flow capacity of the CNG station and providing the ability to increase and adjust its flow capacity; and dispensing the gas.

13. The method of claim 12, wherein the CNG station design utilizes inlet gas from a local gas utility.

14. The method of claim 12, wherein a gas inlet section for metering inlet gas from the high pressure storage vessel is provided and delivered to the site location by a local gas utility.

15. The method of claim 12, wherein the compressor comprises a single high pressure reciprocating compressor.

16. The method of claim 15, wherein the high pressure compressor comprises a rotary, single-screw, positive-displacement compressor including a drive shaft, a main screw having six helical grooves, and two planar gaterotors.

17. The method of claim 12, wherein the compressor comprises a combination of multiple reciprocating compressors configured in parallel.

18. The method of claim 12, further comprising directing the flow of gas from the compressor to either local storage vessels or to a dispensing section for dispensing the gas.

19. The method of claim 12, wherein depressurizing high pressure gas is performed by a pressure let down section that draws the gas from the high pressure vessel at a pressure from 3600 psig to 4500 psig down to a pressure of 20 psig to 200 psig before it enters the compressor section.

20. The method of claim 19, wherein the pressure let down section allows the compressor to operate at a high flow capacity during peak hours, and wherein the pressure let down section allows the compressor to draw in gas from the local gas utility and refill the high pressure storage vessels at a slower flow capacity and at a lower power level during non-peak hours.

21. The method of claim 20, wherein the ability to provide higher flow during peak hours and slower flow during non-peak hours provides the CNG station with the ability to actively manage the gas supply and demand levels and control the power draw requirement of the CNG station.

* * * * *